US008176657B2

(12) United States Patent
Schinlder et al.

(10) Patent No.: US 8,176,657 B2
(45) Date of Patent: May 15, 2012

(54) ARTICLE OF FOOTWEAR WITH TUBULAR SUPPORT STRUCTURE

(75) Inventors: Eric S. Schinlder, Portland, OR (US); Elizabeth P. Barnes, Beaverton, OR (US); Randall S. Wolfe, Beaverton, OR (US); Bruce J. Kilgore, Lake Oswego, OR (US)

(73) Assignee: NIKE, Inc., Beaverton, OR (US)

( * ) Notice: Subject to any disclaimer, the term of this patent is extended or adjusted under 35 U.S.C. 154(b) by 1148 days.

(21) Appl. No.: 11/566,254

(22) Filed: Dec. 4, 2006

(65) Prior Publication Data

US 2008/0127513 A1 Jun. 5, 2008

(51) Int. Cl.

| | |
|---|---|
| ***A43B 13/28*** | (2006.01) |
| ***A43B 13/18*** | (2006.01) |
| ***A43B 21/06*** | (2006.01) |
| ***A43B 21/24*** | (2006.01) |
| ***A43B 21/26*** | (2006.01) |
| ***A43B 23/00*** | (2006.01) |

(52) U.S. Cl. ..... 36/28; 36/27; 36/35 R; 36/107

(58) Field of Classification Search ..... 36/103, 36/3 B, 27–29, 37, 35 R, 3 R, 147, 71, 31, 36/107

See application file for complete search history.

(56) References Cited

U.S. PATENT DOCUMENTS

| | | | | |
|---|---|---|---|---|
| 1,498,838 A | | 3/1923 | Harrison, Jr. | |
| 4,547,919 A | * | 10/1985 | Wang | 428/116 |
| 4,593,482 A | | 6/1986 | Mayer | |
| 4,753,021 A | | 6/1988 | Cohen | |
| 4,782,603 A | | 11/1988 | Brown | |
| 4,864,738 A | | 9/1989 | Horovitz | |
| 5,005,300 A | | 4/1991 | Diaz et al. | |
| 5,224,277 A | * | 7/1993 | Sang Do | 36/27 |
| 5,353,526 A | * | 10/1994 | Foley et al. | 36/92 |
| 5,461,800 A | | 10/1995 | Luthi et al. | |
| D364,036 S | | 11/1995 | Passke | |
| D366,756 S | | 2/1996 | Forland et al. | |
| 5,625,963 A | | 5/1997 | Miller et al. | |
| 5,628,128 A | | 5/1997 | Miller et al. | |
| D386,590 S | | 11/1997 | Cass | |
| 5,797,199 A | | 8/1998 | Miller et al. | |
| D397,543 S | | 9/1998 | Silvers | |
| 5,822,886 A | | 10/1998 | Luthi et al. | |

(Continued)

FOREIGN PATENT DOCUMENTS

CA 2538656 A1 12/2006

(Continued)

OTHER PUBLICATIONS

Search Report issued in PCT/US2007/085685 dated May 28, 2008.

(Continued)

*Primary Examiner* — Khoa Huynh
*Assistant Examiner* — Melissa Lalli
(74) *Attorney, Agent, or Firm* — Banner & Witcoff, Ltd.

(57) ABSTRACT

An article of footwear includes an upper and a sole assembly. The sole assembly is secured to the upper and includes a support assembly. The support assembly has a plurality of primary tubular members spaced from one another and extending laterally across at least a portion of the sole assembly. A plurality of secondary tubular members extends laterally across at least a portion of the sole assembly, with each secondary tubular member positioned between and interconnecting a pair of adjacent primary tubular members.

30 Claims, 4 Drawing Sheets

U.S. PATENT DOCUMENTS

| | | | | |
|---|---|---|---|---|
| 6,122,785 | A | 9/2000 | Bondie et al. | |
| D467,725 | S | 12/2002 | McDowell | |
| 6,769,202 | B1 * | 8/2004 | Luthi et al. | 36/28 |
| D499,541 | S | 12/2004 | Dolan | |
| D500,585 | S | 1/2005 | Wahoske et al. | |
| 6,848,201 | B2 | 2/2005 | Staffaroni et al. | |
| 6,871,420 | B2 * | 3/2005 | Shikhashvili | 36/8.1 |
| 6,971,193 | B1 * | 12/2005 | Potter et al. | 36/141 |
| 7,013,582 | B2 | 3/2006 | Lucas et al. | |
| D522,230 | S | 6/2006 | Young | |
| 7,132,032 | B2 * | 11/2006 | Tawney et al. | 156/290 |
| 7,216,443 | B2 * | 5/2007 | Baden et al. | 36/34 R |
| 7,383,647 | B2 * | 6/2008 | Chan et al. | 36/28 |
| 7,398,608 | B2 * | 7/2008 | Schoenborn | 36/28 |
| 7,484,317 | B2 * | 2/2009 | Kita et al. | 36/27 |
| 7,707,743 | B2 * | 5/2010 | Schindler et al. | 36/28 |
| 2004/0154189 | A1 * | 8/2004 | Wang | 36/28 |

FOREIGN PATENT DOCUMENTS

| | | | |
|---|---|---|---|
| CN | 1125385 | A | 6/1996 |
| CN | 1372443 | A | 10/2002 |
| EP | 0877177 | A2 | 11/1998 |
| EP | 1857003 | A2 | 11/2007 |
| GB | 233538 | | 5/1925 |
| WO | 9424896 | A1 | 11/1994 |
| WO | 0170060 | A2 | 9/2001 |

OTHER PUBLICATIONS

International Preliminary Report on Patentability issued on Jun. 18, 2009 in connection with corresponding PCT/US2007/085685.

English translation of Office Action issued Jan. 28, 2011 in related Chinese Patent Application No. 200780044938.1.

* cited by examiner

ARTICLE OF FOOTWEAR WITH TUBULAR SUPPORT STRUCTURE

FIELD OF THE INVENTION

This invention relates generally to footwear, and, in particular, to an article of footwear with a tubular support structure.

BACKGROUND OF THE INVENTION

A conventional article of athletic footwear includes two primary elements, an upper and a sole structure. The upper provides a covering for the foot that securely receives and positions the foot with respect to the sole structure. In addition, the upper may have a configuration that protects the foot and provides ventilation, thereby cooling the foot and removing perspiration. The sole structure is secured to a lower portion of the upper and is generally positioned between the foot and the ground. In addition to attenuating ground reaction forces (i.e., imparting cushioning), the sole structure may provide traction and control foot motions, such as pronation. Accordingly, the upper and the sole structure operate cooperatively to provide a comfortable structure that is suited for a variety of ambulatory activities, such as walking and running.

The sole structure of athletic footwear generally exhibits a layered configuration that may include a comfort-enhancing insole, a resilient midsole formed from a polymer foam material, and a ground-contacting outsole that provides both abrasion-resistance and traction. The midsole is the primary sole structure element that imparts cushioning and controls foot motions. Suitable polymer foam materials for the midsole include ethylvinylacetate or polyurethane, which compress resiliently under an applied load to attenuate ground reaction forces created by the impacts of running and jumping. Conventional polymer foam materials are resiliently compressible, in part, due to the inclusion of a plurality of open or closed cells that define an inner volume substantially displaced by gas. The polymer foam materials of the midsole may also absorb energy when compressed during ambulatory activities. The compression of the foam is affected by hysteresis loss, and deflection of such systems is affected by the volume of the compressed mass of the midsole.

The mechanical structures of the footwear must be capable of providing rigidity to accommodate in-use stresses while remaining compliant enough to provide impact absorption. The variety of rates, magnitudes and distributions of the loads encountered in use also require a non-buckling, progressive stiffness structure to properly handle different activities, surfaces, and users of the footwear.

It would be desirable to provide a simple, highly efficient structure with low production costs and simplified manufacturing processes. It would also be desirable to provide an article of footwear that reduces or overcomes some or all of the difficulties inherent in prior known devices. Particular objects and advantages will be apparent to those skilled in the art, that is, those who are knowledgeable or experienced in this field of technology, in view of the following disclosure of the invention and detailed description of certain embodiments.

SUMMARY

The principles of the invention may be used to advantage to provide an article of footwear with a tubular support structure. In accordance with a first aspect, an article of footwear includes an upper and a sole assembly. The sole assembly is secured to the upper and includes a support assembly. The support assembly has a plurality of primary tubular members spaced from one another and extending laterally across at least a portion of the sole assembly. A plurality of secondary tubular members extends laterally across at least a portion of the sole assembly, with each secondary tubular member positioned between and interconnecting a pair of adjacent primary tubular members.

In accordance with another aspect, an article of footwear includes an upper and a sole assembly secured to the upper. The sole assembly includes a support assembly. The support assembly has a first portion including a plurality of primary tubular members spaced from one another and extending laterally across a portion of the sole assembly, and a plurality of secondary tubular members extending laterally across a portion of the sole assembly, with each secondary tubular member positioned between and interconnecting a pair of adjacent primary tubular members. A second portion is spaced from the first portion and includes a plurality of primary tubular members spaced from one another and extending laterally across a portion of the sole assembly, and a plurality of secondary tubular members extending laterally across a portion of the sole assembly, with each secondary tubular member positioned between and interconnecting a pair of adjacent primary tubular members.

In accordance with a further aspect, an article of footwear includes an upper, and a midsole secured to the upper and having a recess formed therein. An outsole is secured to the midsole. A support assembly is positioned in a heel portion of the midsole and has a first portion including a plurality of substantially circular tubular members spaced from one another and extending laterally across a portion of the sole assembly, and a plurality of substantially elliptical tubular members extending laterally across a portion of the sole assembly, with each substantially elliptical tubular member positioned between and interconnecting a pair of adjacent substantially circular tubular members. A second portion is spaced from the first portion such that the recess is positioned between the first and second portions and includes a plurality of substantially circular tubular members spaced from one another and extending laterally across a portion of the sole assembly, and a plurality of substantially elliptical tubular members extending laterally across a portion of the sole assembly, with each substantially elliptical tubular member positioned between and interconnecting a pair of adjacent substantially circular tubular members.

Substantial advantage is achieved by providing an article of footwear with a tubular support structure. In particular, certain embodiments provide a non-buckling, progressive stiffness structure suited to handle varied activities and surfaces encountered by a user of the footwear.

These and additional features and advantages disclosed here will be further understood from the following detailed disclosure of certain embodiments.

Figure 1:
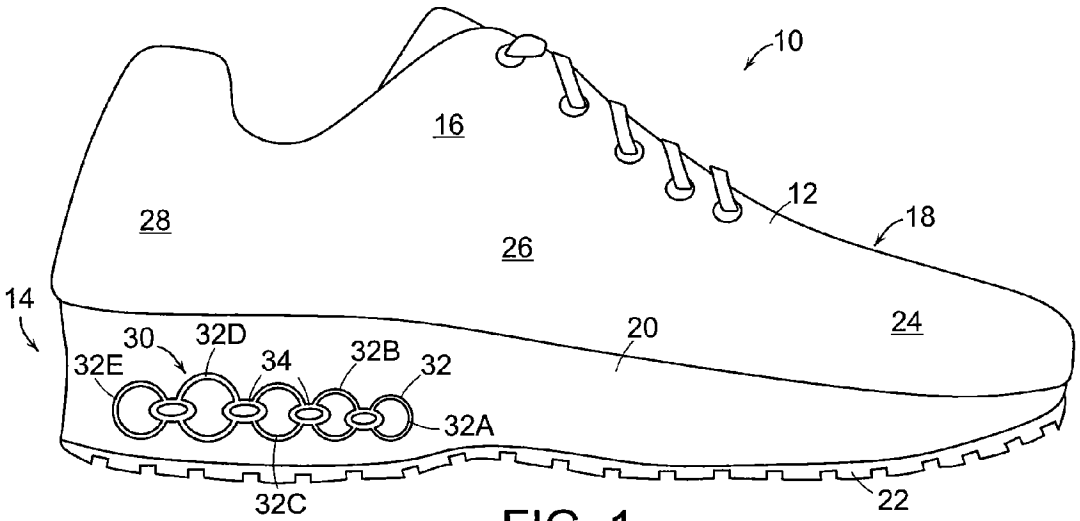
FIG. 1 is an elevation view of an article of footwear with a tubular support structure.

The figures referred to above are not drawn necessarily to scale and should be understood to provide a representation of the invention, illustrative of the principles involved. Some features of the article of footwear with a tubular support structure depicted in the drawings have been enlarged or distorted relative to others to facilitate explanation and understanding. The same reference numbers are used in the drawings for similar or identical components and features shown in various alternative embodiments. Articles of footwear with a tubular support structure as disclosed herein would have configurations and components determined, in part, by the intended application and environment in which they are used.

DETAILED DESCRIPTION OF CERTAIN PREFERRED EMBODIMENTS

The present invention may be embodied in various forms. A preferred embodiment of an article of footwear 10 is shown in FIG. 1. Footwear 10 includes an upper 12 and a sole assembly 14 secured to upper 12. Sole assembly 14 may be secured to upper 12 by adhesive or any other suitable means. Footwear 10 has a medial, or inner, side 16 and a lateral, or outer, side 18.

Sole assembly 14, which is generally disposed between the foot of the wearer and the ground, provides attenuation of ground reaction forces (i.e., imparting cushioning), traction, and may control foot motions, such as pronation. As with conventional articles of footwear, sole assembly 14 may include an insole (not shown) located within upper 12, a midsole 20, and an outsole 22.

Upper 12 forms an interior void that comfortably receives a foot and secures the position of the foot relative to sole assembly 14. The configuration of upper 12, as depicted, is suitable for use during athletic activities, e.g., running. Accordingly, upper 12 may have a lightweight, breathable construction that includes multiple layers of leather, textile, polymer, and foam elements adhesively bonded and stitched together. For example, upper 12 may have an exterior that includes leather elements and textile elements for resisting abrasion and providing breathability, respectively. The interior of upper 12 may have foam elements for enhancing the comfort of footwear 10, and the interior surface may include a moisture-wicking textile for removing excess moisture from the area immediately surrounding the foot.

Midsole 20 is attached to upper 12 and functions as the primary shock-attenuating and energy-absorbing component of footwear 10. Midsole 20 may be secured to upper 12 by adhesive or other suitable means. Outsole 22 is attached to the lower surface of midsole 20 by adhesive or other suitable means. Suitable materials for outsole 22 include traditional rubber materials. Other suitable materials for outsole 22 will become readily apparent to those skilled in the art, given the benefit of this disclosure. In certain embodiments, sole assembly 14 may not include an outsole layer separate from midsole 20 but, rather, the outsole may comprise a bottom surface of midsole 20 that provides the external traction surface of sole assembly 14.

For purposes of general reference, as illustrated here, footwear 10 may be divided into three general portions: a forefoot portion 24, a midfoot portion 26, and a heel portion 28. Portions 24, 26, and 28 are not intended to demarcate precise areas of footwear 10. Rather, portions 24, 26, and 28 are intended to represent general areas of footwear 10 that provide a frame of reference during the following discussion.

Unless otherwise stated, or otherwise clear from the context below, directional terms used herein, such as rearwardly, forwardly, top, bottom, inwardly, downwardly, upwardly, interior, exterior, etc., refer to directions relative to footwear 10 itself. Footwear 10 is shown in FIG. 1 to be disposed substantially horizontally, as it would be positioned on a horizontal surface when worn by a wearer. However, it is to be appreciated that footwear 10 need not be limited to such an orientation. Thus, in the illustrated embodiment of FIG. 1, rearwardly is toward heel portion 28, that is, to the left as seen in FIG. 1. Naturally, forwardly is toward forefoot portion 24, that is, to the right as seen in FIG. 1, and downwardly is toward the bottom of the page as seen in FIG. 1. Top refers to elements toward the top of the page as seen in FIG. 1, while bottom refers to elements toward the bottom of the page as seen in FIG. 1. Inwardly or interior is toward the center of footwear 10, and outwardly or exterior is toward the outer peripheral edge of footwear 10.

Figure 2:
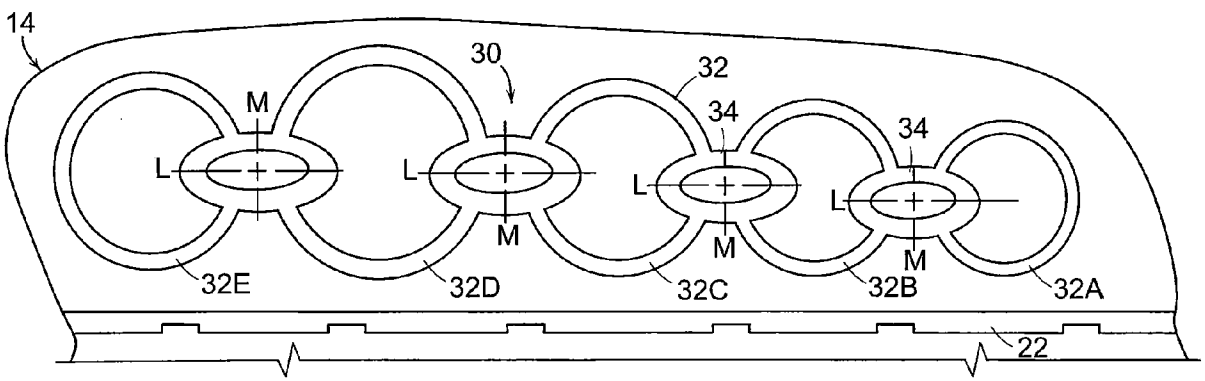
FIG. 2 is an enlarged view of the tubular support structure of the article of footwear of FIG. 1.

Sole assembly 14 includes a support assembly 30, formed as a part of midsole 20. Support assembly 30 includes a plurality of primary tubular members 32 spaced apart from one another. A plurality of secondary tubular members 34 are positioned in the sole assembly 14, with each secondary tubular member 34 being interconnected with and overlapping a pair of adjacent primary tubular members 32. Each secondary tubular member 34 has a major axis that is substantially collinear and that extends along a center of each of the primary tubular members of the respective pair of adjacent primary tubular members 32. Each secondary tubular member 34 is spaced from each adjacent secondary tubular member 34 by one of the pair of adjacent primary tubular members 32, such that the primary tubular members 32 and the secondary tubular members 34 are alternating as seen in FIG. 2. In certain embodiments, primary tubular members 32 and secondary tubular members 34 are of unitary, that is, one-piece construction.

It is to be appreciated that in certain preferred embodiments, midsole may be formed of an upper portion and a lower portion joined together with adhesive or other suitable fastening means, with support assembly 30 captured between the upper and lower portions of midsole 20.

In the illustrated embodiment, primary tubular members 32 are substantially circular in cross-section and secondary tubular members 34 are substantially elliptical in cross-section. Thus, the height and width of primary tubular members 32 is equal to the diameter of their circular cross-section, while the height of secondary tubular members 34 is the length of their minor axis M and the width of secondary tubular members 34 is the length of their major axis L, as seen in FIG. 2. Each secondary tubular member 34 has a height that is less than a height of each primary tubular member 32.

It is to be appreciated that primary tubular members 32 could be substantially elliptical in cross-section with secondary tubular members 34 having a substantially circular cross-section. Other suitable cross-sectional shapes for primary tubular members 32 and secondary tubular members 34 will become readily apparent to those skilled in the art, given the benefit of this disclosure. For example, it is to be appreciated that the cross-section of any, or all, of primary and secondary tubular members 32, 34 could vary along their length. Thus, for example, a tubular member may be elliptical in cross-section at one end and transition to a circular cross-section at its other end. In other embodiments, a tubular member may start at one end with one cross-section, such as elliptical or circular, transition to another cross-section part way along its length, and then transition back to its original cross-section at the opposite end.

Additionally it is to be appreciated that a tubular member may have a mixed or blended cross-section. Thus, for example, a tubular member may have a lower half with an elliptical cross-section, and an upper half with a circular cross-section, or vice versa. Accordingly, it can be seen that any combination of cross-sectional shapes is possible for one or all of any of the tubular members, or any part thereof.

Midsole 20 may be formed by pouring a material into a mold about support assembly 30. In other embodiments, midsole may be formed of two separate portions. Support assembly 30 can then be positioned between the two portions, and the two portions can then be secured to one another with adhesive or other suitable fastening means.

In the illustrated embodiment, the major axes L of secondary tubular members 34 are substantially collinear and extend horizontally along sole assembly 14 in a direction extending from heel portion 28 to forefoot portion 24. Naturally, the minor axes M of secondary tubular members 34 extend vertically within sole assembly 14 and are substantially parallel to, and spaced from, one another.

In the illustrated embodiment, five (5) primary tubular members 32A, 32B, 32C, 32D and 32E are positioned in heel portion 28 of sole assembly 14. Primary tubular member 32A is the foremost primary tubular member, with primary tubular member 32B positioned rearwardly of primary tubular member 32A. Primary tubular member 32B has a slightly larger diameter than primary tubular member 32A. Primary tubular member 32C is positioned rearwardly of primary tubular member 32B and has a slightly larger diameter than primary tubular member 32B. Primary tubular member 32D is positioned rearwardly of primary tubular member 32C and has a slightly larger diameter than primary tubular member 32C. Primary tubular member 32E is positioned rearwardly of primary tubular member 32D and has a slightly smaller diameter than primary tubular member 32D. Suitable sizes for primary tubular members 32A-E will become readily apparent to those skilled in the art, given the benefit of this disclosure.

Although five primary tubular members 32 are illustrated in this embodiment, it is to be appreciated that any number of primary tubular members 32 can be provided in sole assembly 14. Additionally, although support assembly 30 in this embodiment is positioned entirely within heel portion 28 of sole assembly 14, it is to be appreciated that support assembly 30 can be positioned at any location in sole assembly 14. Support assembly 30 can be positioned in any of heel portion 28, midfoot portion 26, forefoot portion 24, or any combination thereof. Thus, for example, support assembly 30 could extend from heel portion 28, through midfoot portion 26 to forefoot portion 24.

In the illustrated embodiment, there are four secondary tubular members 34 interconnecting the primary tubular members 32A-32E. As illustrated here, each of these secondary tubular members 34 is approximately the same size. It is to be appreciated that the secondary tubular members 34 need not be the same size. Secondary tubular members 34 may all have different sizes, or some may have one size while one, or more, have another size or sizes. Suitable sizes for secondary tubular members 34 will become readily apparent to those skilled in the art, given the benefit of this disclosure.

In certain embodiments, opposed ends of primary tubular members 32 and secondary tubular members 34 are exposed, that is, they are visible from the exterior of sole assembly 14. It is to be appreciated that, in certain embodiments, one or more primary tubular members 32 and/or secondary tubular members 34 can be concealed within sole assembly 14, either partially or entirely.

In the illustrated embodiment, primary tubular members 32 and secondary tubular members 34 extend substantially laterally across sole assembly 14 from medial side 16 to lateral side 18. It is to be appreciated that primary tubular members 32 and secondary tubular members 34 need not extend entirely across sole assembly 14, and that they may extend in different directions in other embodiments.

Primary tubular members 32 and secondary tubular members 34 may be formed of a thermoplastic elastomer material such as polyurethane or thermoplastic polyurethane (TPU), or a thermoplastic polyester elastomer such as Hytrel®, available from Dupont. Other suitable materials for the tubular members will become readily apparent to those skilled in the art, given the benefit of this disclosure.

Figure 3:
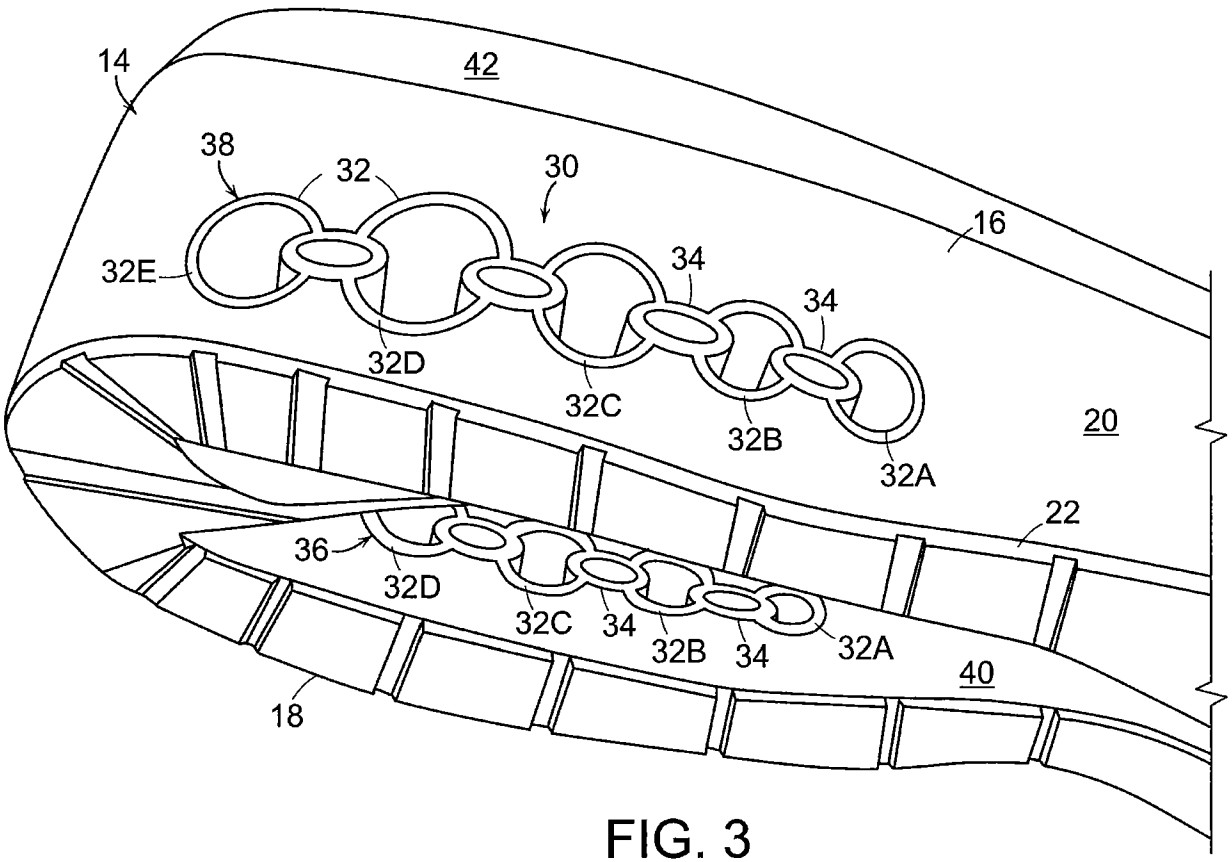
FIG. 3 is a perspective view of a heel portion of an article of footwear with a tubular support structure.

In certain embodiments, as illustrated in FIG. 3, support assembly 30 is formed of a plurality of portions. In the embodiment illustrated here, support assembly 30 is formed of a first portion 36 and a second portion 38. First portion 36 is positioned in lateral portion 18 of heel portion 28 and second portion 38 is positioned in medial portion 16. A recess 40 is formed in heel portion 28 of midsole 20, separating first portion 36 from second portion 38.

In certain embodiments, a plate 42 is positioned in midsole 20, above support assembly 30. Plate 42 may serve to provide stability and support in embodiments where support assembly 30 is provided in multiple portions. Plate 42 serves to distribute forces across the tubular members of support assembly 30, which is particularly advantageous in embodiments with a central void present in footwear 10. Plate 42 may be formed of acrylonitrile butadiene styrene (ABS) or other plastic or rigid materials, for example.

It is to be appreciated that support assembly 30 can be formed with more than two portions in other embodiments, and that these portions can be positioned at any location within sole assembly 14.

Figure 4:
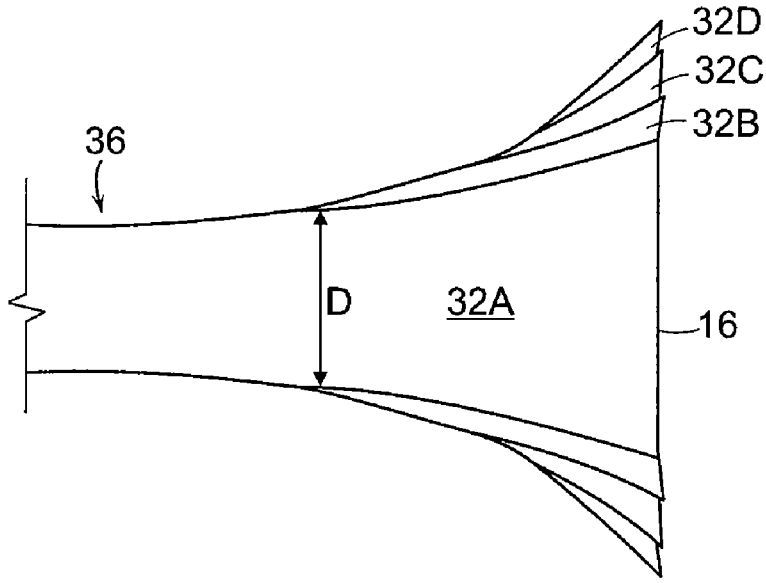
FIG. 4 is an elevation view of the tubular support structure of the article of footwear of FIG. 1.
Figure 5:
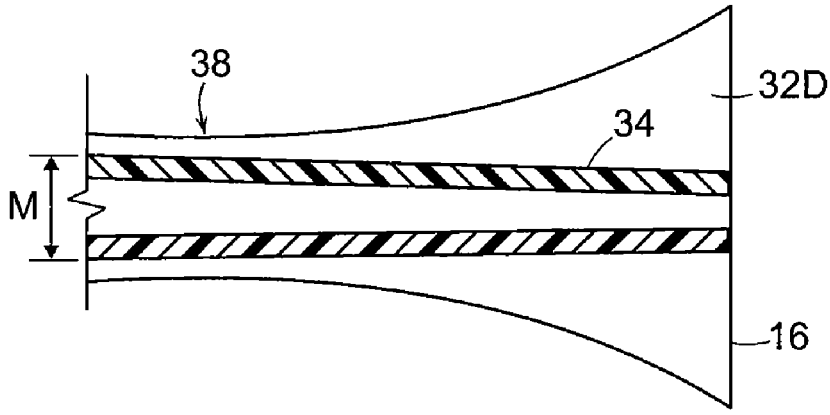
FIG. 5 is an elevation view, shown partially in section, of a portion of the tubular support structure of the article of footwear of FIG. 1.

Another embodiment is shown in FIGS. 4-5, in which it can be seen that primary tubular members 32 and secondary tubular members 34 have a non-constant height along their length. As seen in FIG. 4, the height of each primary tubular member increases along its length from a central portion towards opposed ends thereof. Thus, as shown here, where primary tubular members 32A-D are substantially circular, each of their diameters D increases from a central portion thereof as it approaches medial side 16. A similar construction may be found on lateral side 18 (not shown), where the diameters of each of the primary tubular members 32 increases from a central portion thereof as it approaches lateral side 18. Having a greater diameter at medial side 16 and lateral side 18 provides a cradling structure, which is particularly advantageous in heel portion 28 of footwear 10.

It is to be appreciated that, in certain embodiments, the cross-sections of primary and secondary tubular members 32, 34 need not be symmetrical. Thus, for example, the upper portion of one or more of primary tubular members 32A-D may have a height that is larger than, or smaller than, the corresponding height of the lower portion of that primary tubular member. Such an embodiment would be found where one of the upper and lower portions of a tubular member has an elliptical cross-section while the other of the upper and lower portions of the tubular member has a circular cross-section, for example.

Further, it is to be appreciated that the change in height along the primary and secondary tubular members 32, 34 need not be constantly increasing or decreasing. That is, the height may increase along one portion of the length of a tubular member and then decrease along another portion. Thus, for example, the height of a tubular member could increase, then decrease, and then increase again along the length of the tubular member.

As seen in FIG. 5, the height of each secondary tubular member 34, seen here as its minor axis M where it is substantially elliptical, decreases from a central portion thereof as it approaches medial side 16. A similar construction may be found on lateral side 18 (not shown), where the height of each of secondary tubular members 34 decreases from a central portion thereof as it approaches lateral side 18. Varying the height of secondary tubular members 34 in such a manner facilitates molding of support assembly 30.

The combination of secondary tubular members and primary tubular members advantageously provides a two stage response for impact absorption. Initially, secondary tubular members 34 begin to compress upon impact from the user's foot, providing a first response. Next, compression occurs in primary tubular members 32, providing the second stage response. This two stage response provides a more consistent response in footwear 10, allows the varying of stiffness in different areas of footwear 10, and allows the response to vary across the width of ht footwear. For example, during walking, the secondary tubular members will compress, providing cushioning for the user, while during running, where there is a greater impact force, primary tubular members 32 will also compress to provide additional cushioning.

Figure 6:
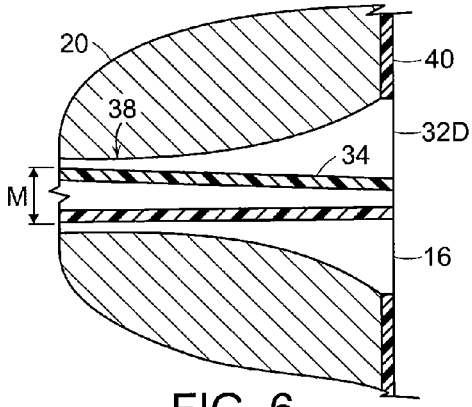
FIG. 6 is section view of another embodiment of an article of footwear with a tubular support structure.

Another embodiment is shown in FIG. 6, in which a peripheral plate 40 is positioned at and extends about at least a portion of the exterior periphery of midsole 20. In the illustrated embodiment, peripheral plate is positioned at the ends of primary tubular members 32 and secondary tubular members 34 and extends vertically along the peripheral edge of midsole 20. Peripheral plate 40 may extend along any portion of midsole 20. Thus, for example, peripheral plate 40 may extend only around heel portion 28 of midsole 20. In other embodiments, peripheral plate may extend about the entire periphery of midsole 20. In other embodiments, a first peripheral plate 40 may be provided on medial side 16 of midsole 20, with a second peripheral plate 40 provided on lateral side 18 of midsole 20. Each of the first and second peripheral plates 40 can have any desired length and be positioned in any or all of forefoot portion 24, midfoot portion 26 or heel portion 28.

Peripheral plate 40 may be formed of a thermoplastic elastomer material such as polyurethane or thermoplastic polyurethane (TPU), or a thermoplastic polyester elastomer such as Hytrel®, available from Dupont. Other suitable materials for peripheral plate 40 will become readily apparent to those skilled in the art, given the benefit of this disclosure. In certain embodiments, peripheral plate 40 may be of unitary, that is, one-piece, construction, with one or more primary and secondary tubular members 32, 34.

Figure 7:
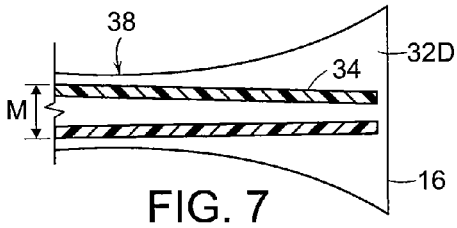
FIG. 7 is an elevation view, shown partially in section, of a portion of another embodiment of a tubular support structure.
Figure 8:
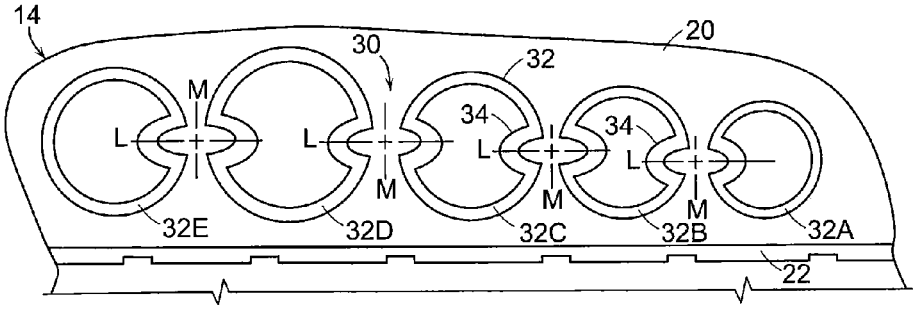
FIG. 8 is an elevation view of an article of footwear with the tubular support structure of FIG. 7.

In certain embodiments, as illustrated in FIGS. 7-8, the lengths of primary tubular members 32 may not be the same as the lengths of secondary tubular members 34. In the illustrated embodiment, secondary tubular members 34 are shorter than primary tubular members 32. In the embodiment illustrated in FIG. 8, only the outer portions of secondary tubular members 34 are visible from the exterior of footwear 10, as midsole 20 covers the central portion of secondary tubular members 34. It is to be appreciated that midsole 20 need not cover the shorter central portion of secondary tubular members 34, and that the shorter central portion could still be visible from the exterior of footwear 10, as seen in FIG. 2 above.

In other embodiments, secondary tubular members 34 could be longer than primary tubular members. Additionally, it is to be appreciated that some or all of secondary tubular members 34 could be shorter than some or all of primary tubular members 32, and that some or all of secondary tubular members 34 could be longer than some or all of primary tubular members 32.

In the illustrated embodiment, each of the primary tubular members 32 has a first length, while each of the secondary primary tubular members 34 has a second length that is different than the first length of the primary tubular members 32. As shown in FIG. 8, the second length is shorter than the first length.

In light of the foregoing disclosure of the invention and description of various embodiments, those skilled in this area of technology will readily understand that various modifications and adaptations can be made without departing from the scope and spirit of the invention. All such modifications and adaptations are intended to be covered by the following claims.

What is claimed is:

1. An article of footwear comprising:

an upper; and a sole assembly secured to the upper and including a midsole and a support assembly positioned within the midsole such that a first portion of the midsole is above the support assembly and a second portion of the midsole is below the support assembly, the support assembly comprising:

a plurality of primary tubular members spaced from one another and extending laterally across at least a portion of the sole assembly; and a plurality of secondary tubular members extending laterally across at least a portion of the sole assembly, each secondary tubular member positioned between and interconnecting and overlapping a pair of adjacent primary tubular members and having a height that is less than a height of each of the primary tubular members, each secondary tubular member having a major axis that is substantially collinear and that intersects with a center of each of the primary tubular members of the respective pair of adjacent primary tubular members, each secondary tubular member spaced from each adjacent secondary tubular member by one of the pair of adjacent primary tubular members, such that the primary tubular members and the secondary tubular members are alternating.

2. The article of footwear of claim 1, wherein each primary tubular member is substantially circular.

3. The article of footwear of claim 1, wherein each secondary tubular member is substantially elliptical.

4. The article of footwear of claim 1, wherein the support assembly includes a plurality of portions spaced from one another.

5. The article of footwear of claim 1, wherein the support assembly includes a first portion positioned in a lateral portion of the sole assembly and a second portion positioned in a medial portion of the sole assembly and spaced from the first portion.

6. The article of footwear of claim 5, further comprising a recess formed in the sole assembly and positioned between the first and second portions of the support assembly.

7. The article of footwear of claim 6, wherein the support assembly is positioned in the midsole and the recess is formed in the midsole.

8. The article of footwear of claim 6, wherein the sole assembly further comprises a plate positioned above the support assembly.

9. The article of footwear of claim 8, wherein the plate is formed of ABS.

10. The article of footwear of claim 1, wherein the primary tubular members and secondary tubular members are of unitary construction with one another.

11. The article of footwear of claim 1, wherein the primary tubular members are formed of urethane.

12. The article of footwear of claim 1, wherein the secondary tubular members are formed of urethane.

13. The article of footwear of claim 1, wherein the support assembly is visible from an exterior of the sole assembly.

14. The article of footwear of claim 1, wherein opposed ends of the primary tubular members and the secondary tubular members are visible from an exterior of the sole assembly.

15. The article of footwear of claim 1, wherein the support assembly is positioned in a heel portion of the sole assembly.

16. The article of footwear of claim 1, wherein each tubular member has a height that varies along its length.

17. The article of footwear of claim 16, wherein the height of each primary tubular member increases along its length from a central portion thereof towards an end thereof.

18. The article of footwear of claim 16, wherein the height of each secondary tubular member decreases along its length from a central portion thereof towards an end thereof.

19. The article of footwear of claim 1, further comprising a peripheral plate positioned at an end of at least one of a primary tubular member and a secondary tubular member.

20. The article of footwear of claim 19, wherein the peripheral plate is of unitary construction with at least one of a primary tubular member and a secondary tubular member.

21. The article of footwear of claim 19, wherein the peripheral plate extends about a portion of an exterior periphery of the midsole.

22. The article of footwear of claim 1, wherein a length of at least one primary tubular member is different than a length of at least one secondary tubular member.

23. The article of footwear of claim 1, wherein each primary tubular member has a first length and each secondary tubular member has a second length that is different from the first length.

24. An article of footwear comprising:

an upper; and a sole assembly secured to the upper and including a midsole and a support assembly positioned within the midsole such that a first portion of the midsole is above the support assembly and a second portion of the midsole is below the support assembly, the support assembly comprising:

a first portion comprising:

a plurality of primary tubular members spaced from one another and extending laterally across a portion of the sole assembly; and a plurality of secondary tubular members extending laterally across a portion of the sole assembly, each secondary tubular member positioned between and interconnecting and overlapping a pair of adjacent primary tubular members and having a height that is less than a height of each of the primary tubular members, each secondary tubular member having a major axis that is substantially collinear and that extends along a center of each of the primary tubular members of the respective pair of adjacent primary tubular members; and a second portion spaced from the first portion and comprising:

a plurality of primary tubular members spaced from one another and extending laterally across a portion of the sole assembly; and a plurality of secondary tubular members extending laterally across a portion of the sole assembly, each secondary tubular member positioned between and interconnecting and overlapping a pair of adjacent primary tubular members and having a height that is less than a height of each of the primary tubular members, each secondary tubular member having a major axis that is substantially collinear and that extends along a center of each of the primary tubular members of the respective pair of adjacent primary tubular members, each secondary tubular member spaced from each adjacent secondary tubular member by one of the pair of adjacent primary tubular members, such that the primary tubular members and the secondary tubular members are alternating.

25. The article of footwear of claim 24, wherein each primary tubular member is substantially circular.

26. The article of footwear of claim 24, wherein each secondary tubular member is substantially elliptical.

27. The article of footwear of claim 24, wherein the first portion and the second portion of the support assembly are positioned in a heel portion of the sole assembly.

28. The article of footwear of claim 24, further comprising a recess formed in the midsole, the recess being positioned between the first and second portions of the support assembly.

29. The article of footwear of claim 24, wherein the sole assembly further comprises a plate positioned above the support assembly.

30. An article of footwear comprising:

an upper; and a midsole secured to the upper and having a recess formed therein;

an outsole secured to the midsole;

a support assembly positioned in a heel portion of the midsole such that a first portion of the midsole is above the support assembly and a second portion of the midsole is below the support assembly and comprising:

a first portion comprising:

a plurality of substantially circular tubular members spaced from one another and extending laterally across a portion of the sole assembly; and a plurality of substantially elliptical tubular members extending laterally across a portion of the sole assembly, each substantially elliptical tubular member positioned between and interconnecting and overlapping a pair of adjacent substantially circular tubular members and having a height that is less than a height of each of the substantially circular tubular members, each substantially elliptical tubular member having a major axis that is substantially collinear and that extends along a center of each of the substantially circular tubular members of the respective pair of adjacent substantially circular tubular members; and a second portion spaced from the first portion such that the recess is positioned between the first and second portions and comprising:

a plurality of substantially circular tubular members spaced from one another and extending laterally across a portion of the sole assembly; and a plurality of substantially elliptical tubular members extending laterally across a portion of the sole assembly, each substantially elliptical tubular member positioned between and interconnecting and overlapping a pair of adjacent substantially circular tubular members and having a height that is less than a height of each of the substantially circular tubular members, each substantially elliptical tubular member having a major axis that is substantially collinear and that extends along a center of each of the substantially circular tubular members of the respective pair of adjacent primary tubular members, each substantially elliptical tubular member spaced from each adjacent substantially elliptical tubular member by one of the pair of adjacent substantially circular tubular members, such that the substantially circular tubular members and the substantially elliptical tubular members are alternating.

* * * * *